US005525863A

United States Patent [19]

Kowalczyk et al.

[11] Patent Number: 5,525,863

[45] Date of Patent: Jun. 11, 1996

[54] HID LAMP HAVING AN ARC TUBE WITH OFFSET PRESS SEALS

[75] Inventors: Lou Kowalczyk, Alfred Station; Bart van der Leeuw, Hammondsport, both of N.Y.

[73] Assignee: North American Philips Corporation, New York, N.Y.

[21] Appl. No.: 373,918

[22] Filed: Jan. 17, 1995

Related U.S. Application Data

[63] Continuation of Ser. No. 916,559, Jul. 20, 1992, abandoned.

[51] Int. Cl.[6] ..... H01J 61/30

[52] U.S. Cl. ..... 313/634; 313/25; 313/573

[58] Field of Search ..... 313/623, 634, 313/25, 573

[56] References Cited

U.S. PATENT DOCUMENTS

| | | | |
|---|---|---|---|
| 2,664,517 | 12/1953 | Wiener . | |
| 2,857,712 | 10/1958 | Yoder et al. | 49/2 |
| 2,965,698 | 8/1956 | Gottschalk . | |
| 3,885,181 | 5/1975 | Nelson et al. | 313/634 |
| 3,939,538 | 2/1976 | Hellman et al. | 29/25.11 |
| 4,001,623 | 1/1977 | Howles et al. | 313/184 |
| 4,056,751 | 11/1977 | Gungle et al. | 313/217 |
| 4,232,243 | 11/1980 | Rigden | 313/217 |
| 4,721,887 | 1/1988 | Inukai et al. | 313/623 |
| 4,850,499 | 7/1989 | White et al. | 220/2.1 R |
| 4,959,587 | 9/1990 | Schug | 313/623 |
| 5,016,150 | 5/1991 | Gordin et al. | 362/263 |
| 5,051,655 | 9/1991 | Wiley | 313/631 |
| 5,055,740 | 10/1991 | Sulcs | 313/634 |

FOREIGN PATENT DOCUMENTS

| | | | |
|---|---|---|---|
| 859335 | 12/1952 | Germany | 313/25 |
| 485489 | 5/1938 | United Kingdom | 313/573 |

*Primary Examiner*—Sandra L. O'Shea
*Assistant Examiner*—Matthew J. Esserman
*Attorney, Agent, or Firm*—Brian J. Wieghaus

[57] ABSTRACT

A high pressure discharge lamp having an arc tube for operation in a generally horizontal position. The arc tube has a generally cylindrical body with end chambers of continuously reducing cross-section in which respective discharge electrodes are arranged. Press seals sealing the end of the arc tube in a gas tight-manner are offset from the axis of the cylindrical body in a direction normal to the press seals and away from the tip-off. The lower circumferential portion of the cylindrical body is smoothly curving and free of flats and the lower portions of the end chambers are smoothly curving and free of crevices.

27 Claims, 5 Drawing Sheets

HID LAMP HAVING AN ARC TUBE WITH OFFSET PRESS SEALS

This is a continuation of application Ser. No. 07/916,559, filed on Jul. 20, 1992 now abandoned.

CROSS REFERENCE TO RELATED APPLICATIONS

This application relates to U.S. application Ser. No. 916,573 (now U.S. Pat. No. 5,211,595), filed concurrently herewith, entitled "METHOD OF MANUFACTURING AN ARC TUBE WITH OFFSET PRESS SEALS" of Louis N. Kowalczyk and Bart van der Leeuw which discloses and claims a method of manufacturing an arc tube with offset press seals.

BACKGROUND OF THE INVENTION

The invention relates to a high pressure discharge lamp having an arc tube for operation in a generally horizontal position, said arc tube having a generally cylindrical body defining a cylinder axis, end chambers of continuously reducing cross-section, an arc discharge sustaining filling, a pair of opposing discharge electrodes arranged substantially in said end chambers, and press seals sealing each end of said arc tube in a gas-tight manner.

Lamps of this type are known from U.S. Pat. No. 4,001,623 (Howles et al) which discloses a metal halide lamp. In such lamps, the arc tube is made of quartz glass (fused silica) to withstand the high operating temperature of the arc discharge. The discharge sustaining filling is typically comprised of mercury and a starting gas, along with one or more metal halides such as sodium and scandium halides to improve the color rendering of the lamp.

When a metal halide arc tube is operated horizontally, the arc arches or bows upward due to convection currents within the discharge space. This tends to overheat the upper wall of the arc tube, which leads to a shortened lamp life. The bowed arc also causes an uneven temperature profile between the upper and lower walls of the arc tube, leading to increased condensation of the lamp fill material as compared to a similar vertically operated lamp. This adversely effects photometric parameters such as correlated color temperature (CCT), color rendering (CRI), and luminous efficacy. Thus, arc tubes intended for horizontal operation typically include design features to alleviate these problems.

For example, the above-mentioned Howles patent discloses an arc tube having a cylindrical body with vertically oriented press seals and asymmetric end chambers in which the discharge electrodes extend axially but are offset from the cylinder axis towards the lower wall in the plane of the press seal. This lowers the arc away from the upper wall to provide a more uniform temperature distribution. In a further embodiment, the tipper wall has the shape of a catenary to further improve the temperature profile. U.S Pat. No. 5,055,740 (Sulcs) discloses a similar arc tube in which the greatest length of the arc tube is at the elevation of the electrodes. U.S. Pat. No. 4,056,751 (Gungle et al) discloses an alternative design in which the arc tube is arched to match the shape of the discharge arc during lamp operation. Gungle's arched shape, however, requires extra glass forming steps to bend the arc tube body, and increases the effective diameter of the arc tube, making it unsuitable for lamps intended for small fixtures.

A disadvantage of all of the above designs is that the press seals are vertically-oriented during horizontal operation of the arc tube. It is known from U.S. Pat. No. 4,850,500 (White et al) that end chambers typically include irregularities such as corners and crevices, inadvertently formed during pressing, where they meet the press seals of the arc tube. Thus, rather than the smoothly shaped end chamber walls shown in the Howles and Sulcs patents, in practice these lamps have been found to have crevices "C" at the juncture of the press seals and the end chamber, as shown in FIG. 1. When operated horizontally, the cold spot on the arc tube is generally on the lower wall, and typically behind the electrodes. With vertically oriented press seals, it has been found that the fill constituents tend to condense and pool in the crevices, reducing the partial pressures of the constituents. The crevices are the source of a larger than desired spread in photometric parameters among a given number of lamps due to the variation in the size and location of the crevices produced during pressing.

In White et al, the corners are reduced or eliminated by an additional, secondary pressing operation normal to the major press which forms notches, or "dimples", at the juncture of the arc tube body and press seal. However, the secondary pressing operation is an additional manufacturing step, requiring additional press jaws and modified pressing equipment, which adds to lamp cost. Furthermore, White's arc tube has a straight cylindrical body with centered axially extending discharge electrodes. This construction suffers from the asymmetric temperature profile of the arc tube wall due to the arched discharge arc as discussed above.

U.S. Pat. No. 5,016,150 (Gordin et al) discloses an embodiment of an HID lamp in which the press seals are horizontally oriented and the electrodes are aligned on the cylinder axis. The lower wall of the arc tube is locally flattened to move it closer to the discharge arc (FIGS. 2A and 2B), which requires the extra steps of heating the arc tube along its lower wall and then pressing it flat. In FIG. 2A, the dashed line represents the lower wall of the arc tube prior to flattening. While reducing the temperature difference between the flattened portion of the lower wall and the upper wall, the problem of overheating of the upper wall is not addressed. Additionally, flattening of the lower wall introduces longitudinal zones "A" having a locally irregular curvature. As shown in FIG. 2*b*, the radius $R_A$ of these zones is larger than the nominal radius R of the unflattened portions of the arc tube. The arc tube wall in these zones is further from the discharge arc than the flattened portion and may be the undesired location for condensation and pooling of the fill constituents.

SUMMARY OF THE INVENTION

Accordingly, it is the object of the invention to provide a high pressure discharge lamp with an arc tube of improved shape that overcomes the above-mentioned performance and manufacturing disadvantages.

The above objects are accomplished in a lamp of the type described in the opening paragraph in that:

the press seals are offset from the cylinder axis in a direction normal to the press seals;

the circumferential portion of the generally cylindrical body towards which the press seals are offset is smoothly curving and free of flats in cross sections normal to the cylinder axis;

the portions of the end chambers extending between the press seals and said circumferential portion are smoothly curving and free of crevices; and in the generally horizontal operating position of the arc tube, the press seals lie substantially horizontally, and said circumferential portion of said generally cylindrical body and said portions of said end chambers lie below the press seals.

The lamp according to the invention has been found to achieve greater uniformity of photometric parameters as compared to prior art lamps having arc tubes with vertically oriented press seals. This is believed to be due to the elimination of crevices from the lower wall portion of the end chambers, below the electrodes in the horizontal position, on which the fill constituents pool. This is achieved while maintaining the offset of the electrodes towards the lower wall to minimize the difference in temperature between the upper and lower walls.

As used herein, the terms "upper" and "lower" refer to the portions or walls of the arc tube which are above and below, respectively, the press seals when the arc tube is in a generally horizontal operating position with the press seals horizontal.

According to a favorable embodiment, both press seals are offset from the cylinder axis by the same distance, thereby lying in a common plane. The discharge electrodes extend axially, aligned with each other and with a central plane normal to the press seals and through the cylinder axis. The discharge electrodes are then equally distant from the respective lower wall of the end chambers and the cylindrical body, providing a favorably symmetric temperature profile across the length of the arc tube.

In another embodiment, the arc tube further includes a starting electrode adjacent one of the discharge electrodes. The lead-throughs of the starting and discharge electrodes are laterally offset in the press seal on opposite sides of the cylinder axis, and the discharge electrode is angled laterally towards the cylinder axis with its tip in the press seal plane and centered on a central plane extending normal to the press seals through the cylinder axis. This arrangement is advantageous because it provides ample spacing between the lead-throughs of the starting and discharge electrodes and between both lead-throughs and the side edges of the press seal so that seal reliability is maintained.

According to a favorable embodiment of the invention, the cylindrical body of the arc tube is a right circular cylinder. This is advantageous because fused silica tubing of circular cross section is used for arc tubes for vertical operation, obviating the need to stock or produce different tube shapes. Circular tubing is also the cheapest and easiest to handle. Furthermore, extra glass forming steps such as bending the tube are not required as in some prior art lamps. Thus, lamp cost is minimized while achieving greater uniformity in performance among manufactured lamps.

These and other aspects and advantages of the invention will become apparent from the drawings and detailed description which follow.

DESCRIPTION OF THE PREFERRED EMBODIMENT

Figure 3:
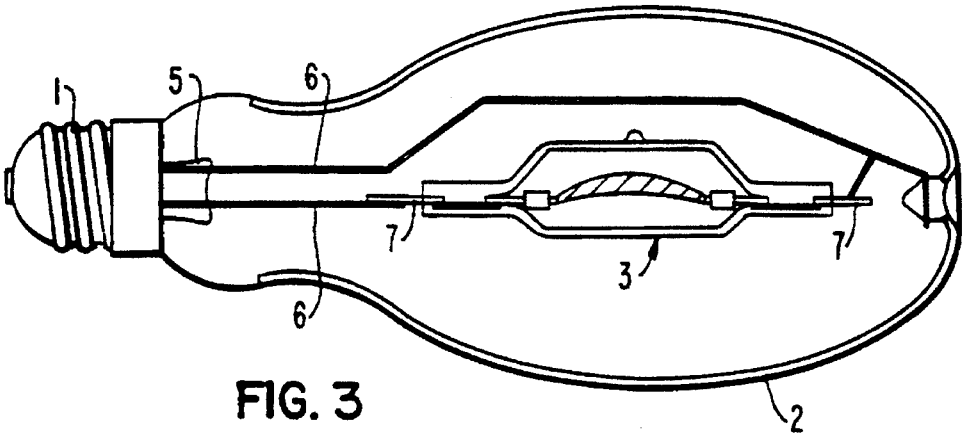
FIG. 3 illustrates an HID metal halide lamp according to the invention having an arc tube with offset press seals mounted within an outer envelope.

FIG. 3 shows an HID metal halide lamp having a lamp base 1 connected to an outer envelope 2 in which an arc tube 3 is disposed. Current supply conductors 6, connected to respective contacts on the lamp base 1, extend from the lamp stem 5 into the outer envelope and are electrically connected to respective conductive lead-throughs 7 of the arc tube 3 for supplying electric current thereto and supporting the arc tube within the outer envelope.

Figure 4A:
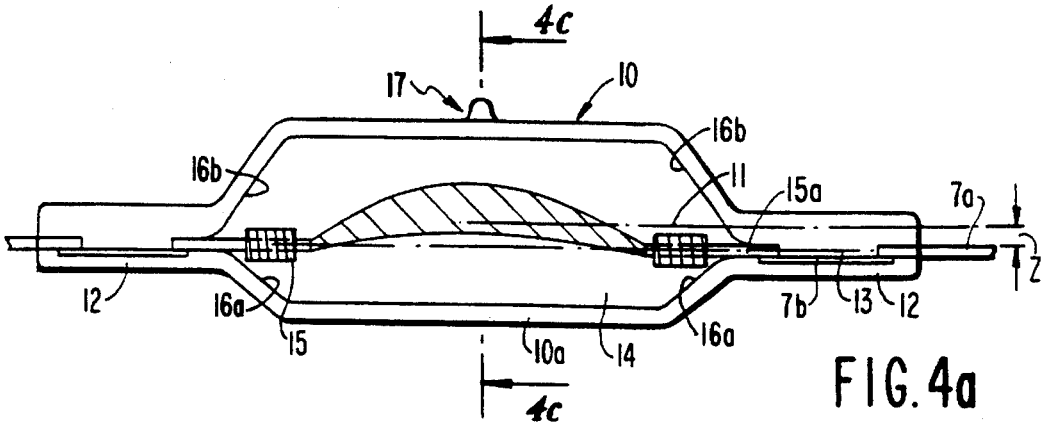
FIG. 4A is a side view of an arc tube according to the invention.
Figure 4B:
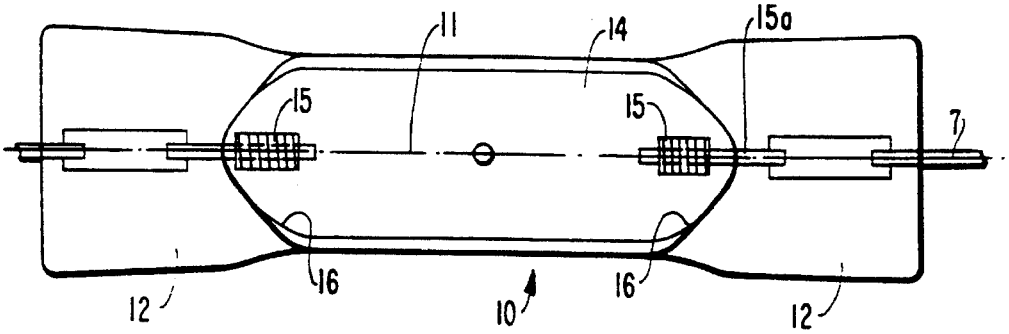
FIG. 4B is a top view of the arc tube of FIG. 4A.

FIGS. 4A, 4B show the arc tube 3 in more detail. The arc tube has a cylindrical body 10 which defines a cylinder axis 11 and is sealed at each end by respective press seals 12 to enclose a discharge space 14. The discharge space contains a conventional filling comprised of mercury, sodium, and one or more metal halides such as scandium iodide and a rare gas, such as argon. The foliated lead-throughs 7 are conventional and include an outer lead 7*a* welded to a molybdenum foil 7*b*. Conventional wire-wound discharge electrodes 15 are disposed in end chambers 16 of continuously reducing cross-section adjacent the press seals 12. The electrode rods 15*a* are welded to the foils 7*b* in a conventional manner.

According to the invention, the press seals 12 are offset from the cylinder axis 11 towards the lower wall 10*a* of the arc tube by a predetermined distance 'z' in a direction normal to the plane of the press seals and away from the tipped-off tubulation 17. The lower circumferential wall portion 10*a* of said generally cylindrical body, towards which the press seals are offset, is smoothly curving and free of flats in cross-sections normal to the cylinder axis. The lower wall portions 16*a* of the end chambers, which extend between the respective press seal 12 and the lower circumferential wall portion 10*a*, are smoothly curving and are free of crevices or other irregularities in which the fill constituents could pool. Any crevices formed during pressing are in the press seal plane at the juncture of the press seal and end chamber and are situated above the lower wall portions 16*a*.

Figure 4C:
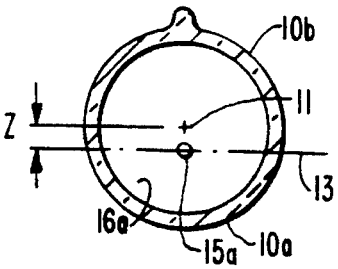
FIG. 4C is a cross-section of the arc tube of FIG. 4*a* taken on the line 4C—4C.

In the embodiment shown in FIGS. 4A–4C, the cylindrical body 10 is a right circular cylinder and the press seals 12 lie in a common plane 13. The discharge electrodes 15 are aligned in said common plane 13 with one another and with a central plane normal to said press seals through the cylinder axis 11. The end chambers 16 are asymmetric about the press seal plane 13 (FIG. 4A). The arc tube is symmetric about the central plane, as illustrated in FIG. 4B. In contrast, the Howles and Sulcs arc tubes are symmetric about the press plane. The specific shape of the end chambers is discussed below in the description of the pressing method.

During lamp operation in its horizontal position shown in FIGS. 3 and 4A, the discharge arc arches upwards due to convection currents in the arc tube. Because the press seals and the discharge electrodes are displaced closer to the lower circumferential wall portion 10*a* and further away from the upper wall portion 10*b*, overheating of the upper wall 10*b* is avoided and a more uniform temperature profile is achieved than if the discharge electrodes were centered on the arc tube axis. During horizontal lamp operation, the cold spot of the arc tube, which is where the metal halide salts condense and which controls the partial pressures of the metal halides, is located on the lower wall 10*a*. Because the end chamber portions 16*a* and the lower wall portion 10*a* are smoothly curving and free of crevices, the surface area of the arc tube over which the metal halides condense and pool is increased. This is favorable for lamp photometric parameters because for a given cold spot temperature the metal halides will be more readily evaporated due to the larger surface area of the salts and have a greater partial pressure as compared to lamps according to the prior art in which the metal halide salts condensed and pooled in crevices in the vertical press seals. Additionally, lamps according to the invention were found to have a smaller lamp-to-lamp variations in photometric parameters because of the absence of crevices in areas where the fill constituents condense. Any crevices which form as the result of the press sealing process lie in the common plane 13 of the press seals, well above the locations at which the lamp fill constituents condense and pool.

Figure 5:
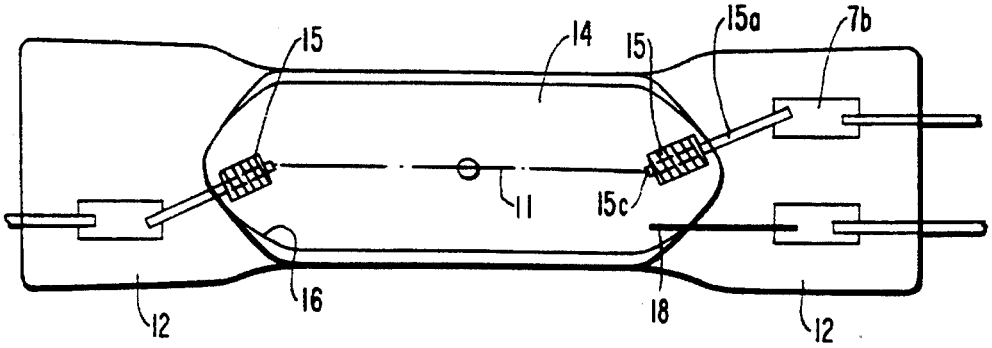
FIG. 5 is a top view of an arc tube according to another embodiment of the invention.

FIG. 5 shows a lamp according to another embodiment of the invention which includes a starting electrode 18 at one end of the arc tube. The lead-throughs 7 of the starting electrode 17 and discharge electrode 15 are positioned in the press seal laterally offset on opposite sides of axis 11. The electrode rod 15*a* of the discharge electrode is welded to the foil 7*b* at an angle such that its tip 15*c* is laterally positioned on the axis 11 in said common plane 13. The starting electrode is conventionally positioned adjacent the discharge electrode to facilitate lamp starting and may be angled towards the cylinder axis or extend axially. The discharge electrode at the other end of the arc tube without the starting electrode may likewise be offset and angled or it may extend axially on the centerline.

Metal halide lamps with starting electrodes are typically those with a rated power of 150 W or greater. Lamps of smaller wattage can typically be started without starting electrodes using a high voltage pulse instead. For manufacturing considerations, lamps without starting electrodes may similarly have one or both discharge electrodes angled in the plane of the press as shown in FIG. 5 to facilitate common tooling.

METHOD OF MANUFACTURE

The above-described arc tube is readily manufacturable. A conventional technique for commercial production of fused silica arc tubes with press seals is described in U.S. Pat. Nos. 2,965,698 (Gottschalk) and 2,857,712 (Yoder et al) (herein incorporated by reference). A length of a cylindrical tube of quartz (fused silica) glass is supported in a press sealing machine. To seal the tube, the lead-through 7 including the discharge electrode 15 is held in a suitable chuck, or holder, and positioned within a respective end portion of the tube and aligned with the longitudinal axis. The end portion of the tube is heated by gas burners to its softening temperature, after which opposing press jaws are moved rapidly against opposing sides of the heated end portion to form a generally planar press seal which is aligned with the tube axis. During heating of the end portions and sealing, a flow of an inert gas such as nitrogen is provided over the lead-throughs to prevent oxidation. The lead-through assemblies are commonly positioned within the end portions of the quartz glass tube prior to heating, but may also be positioned therein during or after heating with the burners.

U.S. Pat. No. 3,939,538 (Hellman et al) discloses a method of making arc tubes for metal halide lamps in which the press jaws further include a mold portion for forming the end chambers. A back pressure of nitrogen is supplied through a conventional tubulation to outwardly blow the softened quartz and mold it against the press jaws to control the shape of the end chambers. When forming the press seal at the first end of the arc tube, a suitable stopper is used to plug the still open end.

In the method according to the invention, the press seals are positioned offset from the longitudinal axis of the tube a predetermined distance in a direction normal to the plane of the press seals.

Figure 6A:
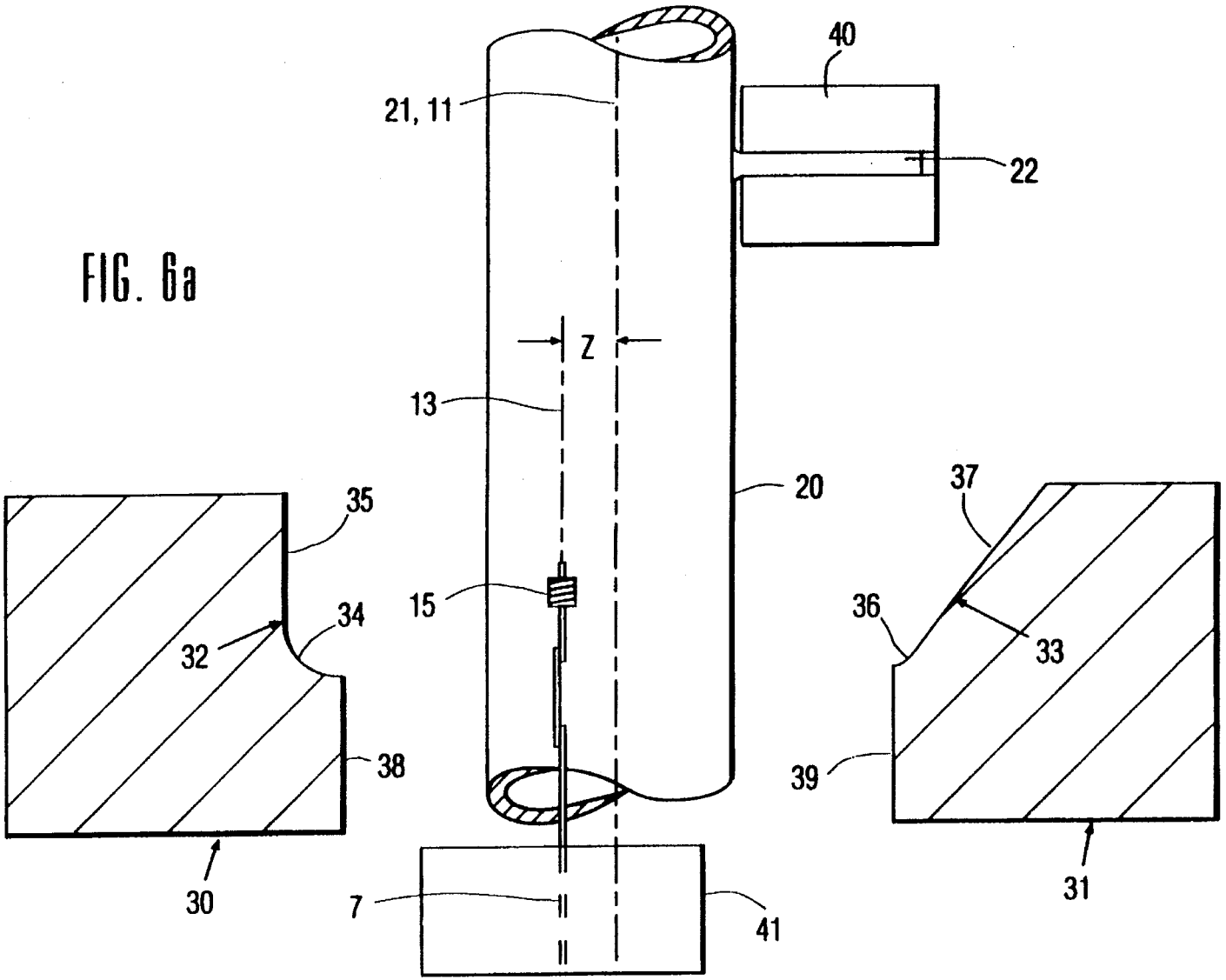
FIGS. 6A and 6B illustrate the arrangement of the fused silica tube, press jaws, and lead-through according to the preferred method of producing the arc tube.
Figure 6B:
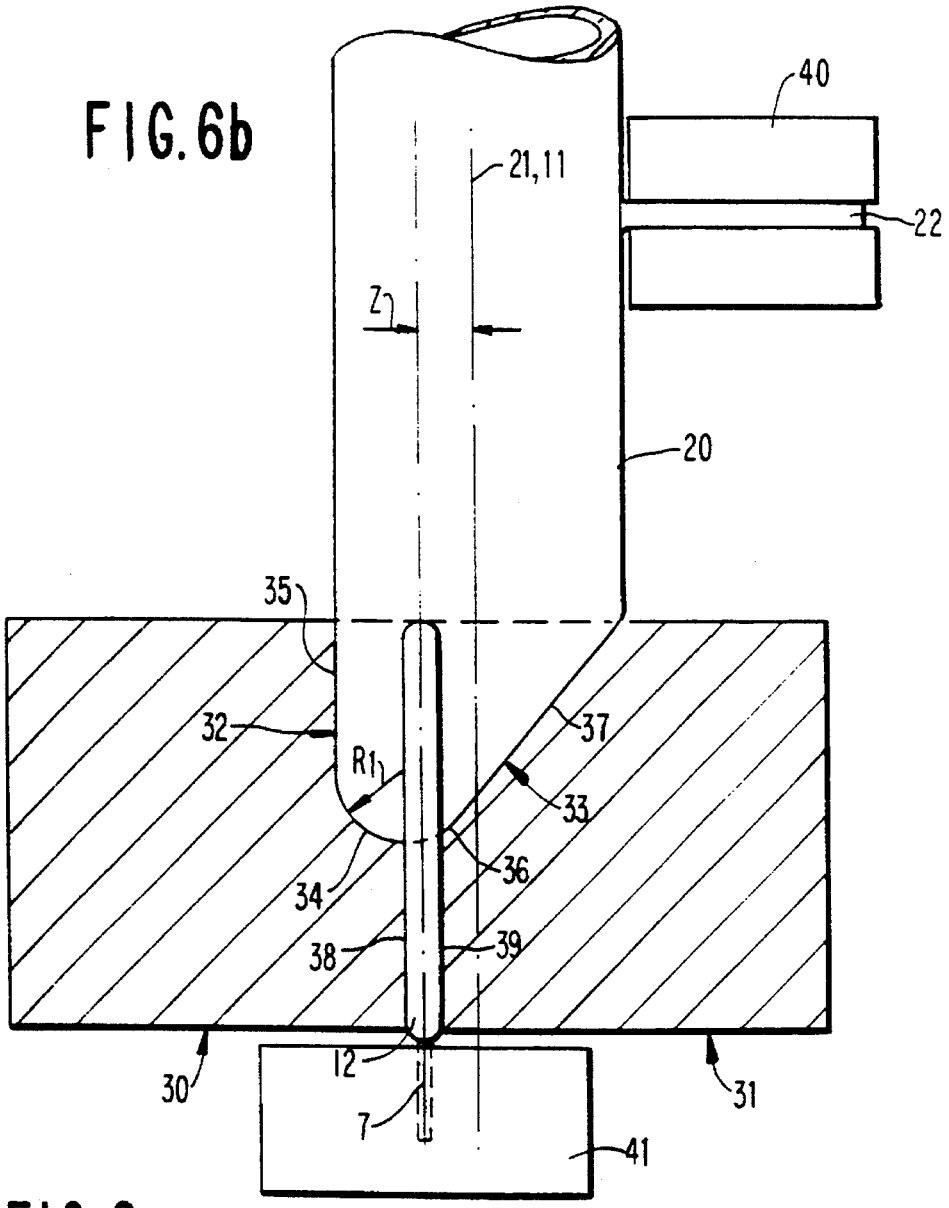

Favorably, this is accomplished by initially forming the press seals offset from the longitudinal axis of the tube according to the following steps. As shown in FIG. 6A, a length of circular cylindrical fused silica tube 20 already provided with a tubulation 22 is held by this tubulation in a tubulation holder 40. The discharge electrode, and the starting electrode if included, are held in a chuck 41 and positioned longitudinally with respect to the quartz glass tube and radially offset from the longitudinal axis 21 (corresponding to the arc tube cylinder axis 11) a predetermined distance "z". The opposing press jaws 30, 31 include mold portions 32, 33 for forming the end chambers. The jaws are arranged and moved so that in their closed position their opposing faces 38, 39 are equidistant from the lead-through 7. After heating the end portion of the tube to its softening temperature in a conventional manner (not shown), the press jaws are quickly pressed together, forming a press seal 12 about the lead-through, offset from the axis 21 and coplanar with the discharge electrode. (FIG. 6B) A back pressure of nitrogen is provided through the tubulation 22 to blow the softened glass outwardly against the mold portions 32, 33 in the closed position of the jaws to precisely form the end chambers.

A press seal is then formed at the other end of the tube offset the same distance "z" from the tube axis such that it is coplanar and symmetric with the press seal formed at the first end. The arc tube is then conventionally dosed through the tubulation, which is then tipped off.

For arc tubes without starting electrodes, the lead-through and electrode may be held in chuck 41 aligned with a plane through the axis 21 and normal to the press seal. Where the arc tube includes a starting electrode, the electrode rod is preferably welded at an angle with respect to the foil 7*b*, as shown in FIG. 5. The lead-throughs of the starting and discharge electrodes are then held in chuck 41 so that they are laterally offset from this plane, for the reasons previously discussed.

Figure 6C:
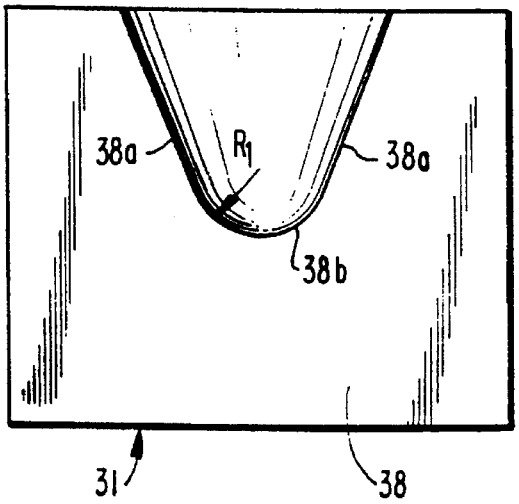
FIG. 6C is a front view of one of the press jaws.

The opposing press jaws are asymmetric with respect to each other (FIG. 6B) in cross-sections normal to the plane of the press seal. The mold portion 32 of the bottom press jaw 30 includes a first arc 34 with a radius R1 merging into a bottom surface 35 parallel to the press plane. The mold portion of the top press jaw 31 includes a second arc 35 with the same radius R1 and a top surface 37 angled with respect to the press plane. The press faces 38, 39 are substantially flat for forming the generally planar press seal about lead-through 7 and may include reliefs for forming detents for frame support straps, etc. As shown in FIG. 6C, the mold portion of the press jaw 30 include angled side edges 38*a* which merge into a rounded edge 38*b* at the face 38. The rounded edge 38*b* has the same radius R1. The press jaw 31 includes identical edges at its face 39, so that the resulting end chamber has a hemispherical portion with radius R1 behind the electrode. The jaws may be readily fabricated accorded to well known machining techniques.

The wall thickness of the end chambers was found to be surprisingly uniform despite the offset of the press seal from the tube axis. Thinning of the upper wall 16*a* as compared to the lower wall 16*b*, which might be expected due to the different distances over which the opposing sides of the softened end portions are displaced by the press jaws, substantially did not occur. This is believed to be due to the blow molding of the heat softened end portion into the mold chambers along with an inherent gathering action of the softened quartz glass. Accordingly, the inner surface of the end chambers is defined by the shape of the press jaw mold portions 32, 33.

The offset "z" of the press seal and the discharge electrode from the tube axis will vary with arc tube size, but will generally be less than about 50% of its inside radius. Too large of an offset will position the electrode too close to the lower wall and cause overheating while too small of an offset will reduce the cold spot temperature below optimum and reduce the salt content in the arc stream. The ratio of the offset "z" to the inner radius will generally be larger as the arc tube wattage and inside radius increase.

Additionally, while the cavity shape of the mold portions (and the corresponding end chamber shape) are typically free of flats, it is feasible that for larger wattage arc tubes, for example 1000 watts, the mold cavities and end chambers may include flats. For example, the lower end chamber 16*a* and corresponding mold portion 30 may include curved side portions extending from the press plane which smoothly merge into a flat bottom portion joining the two curved side portions. Such a shape may facilitate the machining of the mold cavities to ensure smooth merging of the upper and lower end chamber walls at the press seal.

Example

Figure 1:
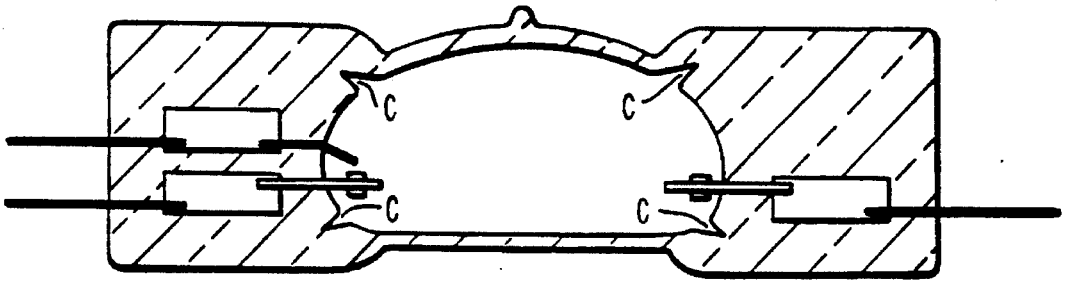
FIG. 1 PRIOR ART
FIG. 1 illustrates an arc tube according to the prior art having vertically oriented press seals and showing the presence of crevices in the end chambers.
Figure 2A:
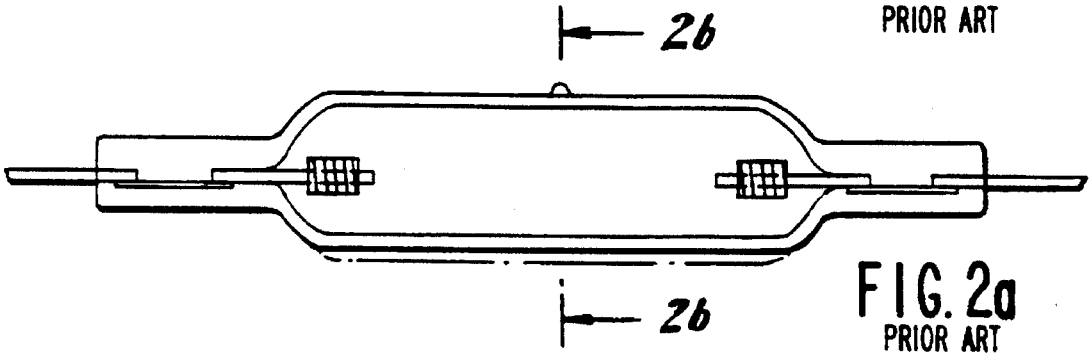
FIG. 2a PRIOR ART
FIG. 2A illustrates another arc tube according to the prior art have a flattened portion on its lower wall.
Figure 2B:
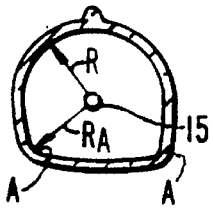
FIG. 2b PRIOR ART
FIG. 2B shows a cross-section of the arc tube of FIG. 2A taken on the line 2B—2B.

In order to establish the operability of lamps according to the invention, 400 W metal halide lamps were made by the above-described method with an offset press seal as shown in FIG. 5 and compared with "Prior Art" lamps having an arc tube with vertical press seals and asymmetric end chambers as shown in FIG. 1. The quartz glass tubing of the lamps according to the invention had a circular cross-section with an inside diameter of 14 mm, the distance between the electrode tips was 43 mm, the insertion depth of the electrode tips from the rear of the end chambers was 7 mm, and the offset distance "z" from the axis of the cylinder was 4 mm. The radius R1 was 4.7 mm. The arc tubes had a filling of argon at a cold fill pressure of 35 Torr and were dosed with 17 mg Hg, 3.9 mg $HgI_2$, 16.1 mg NaI and 1 mg Sc. The prior art lamps with asymmetric press seals had a circular cross-section with an inside diameter of 14 mm, the distance between the electrode tips was 43 mm, the insertion depth of the electrode tips from the rear of the end chambers was 7 mm, and the offset distance 'z' from the axis of the cylinder was 2.5 mm. The arc tubes had a filling of argon at a cold fill pressure of 35 Torr and were dosed with 15 mg Hg, 3.9 mg $HgI_2$, 16.1 mg NaI and 1 mg Sc.

The photometric quantities at 1000 hours are shown in Table 1 for both groups of lamps, each group having 6 lamps. The standard deviation for each measurement is shown in parenthesis.

TABLE 1

| | Offset Press | Asymm. Press |
|---|---|---|
| Lamp Voltage (V) | 146.5 (6.8) | 137.5 (11.7) |
| Lumens | 32070 (1130) | 30894 (2180) |
| Efficacy (LPW) | 80.2 (2.79) | 77.3 (5.5) |
| CCT (K) | 4721 (146) | 5091 (469) |
| CRI | 73.2 (1.5) | 73.4 (2.6) |

While the average photometric parameters were generally comparable between the two groups of lamps, it can be seen that the standard deviation of these parameters were significantly less for the lamps according to the invention having an offset press than the standard deviations for the prior art lamps having an asymmetric press. For example, the standard deviations for the luminous efficacy, correlated color temperature (CCT), and color rendering index (CRI) were 49%, 68% and 42% lower, respectively, for the lamps according to the invention.

Figure 7:
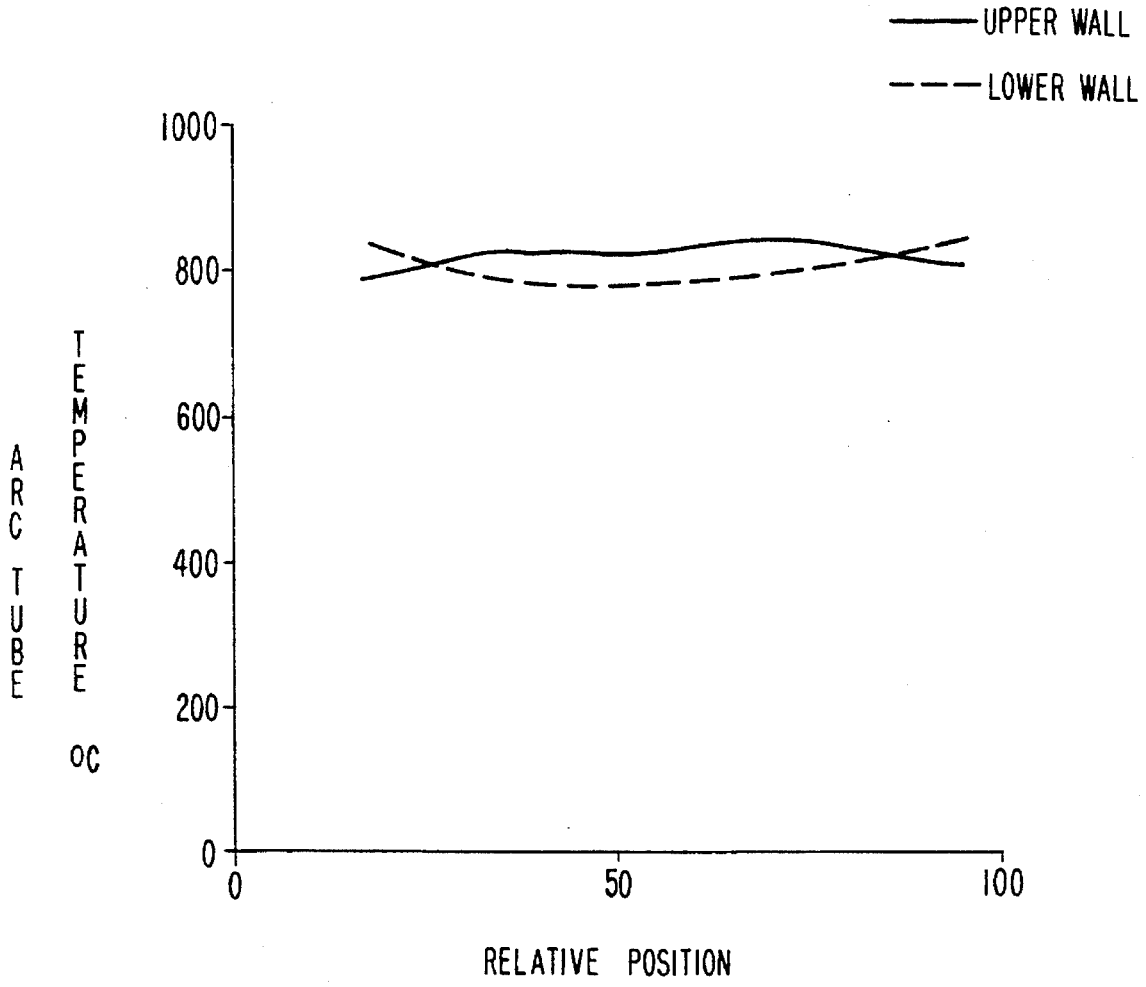
FIG. 7 is a graph illustrating the temperature profile of an arc tube according to FIG. 5.

FIG. 7 shows the temperature profile across the length of the arc tube for the lamp according to the invention. The maximum temperature difference between the upper and lower walls of the arc tube was about 75° C. and the maximum temperature for the upper wall was approximately 850° C. The low temperature difference contributes favorably to lamp performance while the maximum temperature of about 850° C. does not inhibit lamp life.

While there have been shown what are presently considered to be the preferred embodiments of the invention, it will be apparent to those of ordinary skill in the art that various changes and modifications can be made without departing from the scope of the invention as defined by the appended claims. For example, while a circular cylindrical shape is preferred, it is readily apparent that other arc tube cross-sections, such as oval, will benefit from the offset press seals according to the invention.

What is claimed is:

1. An arc tube for an arc discharge lamp, the arc tube having a generally cylindrical body having a cylinder axis defined by the center of mass of the enclosed area of cross-sections of the cylindrical body, end chambers of continuously reducing cross section, discharge electrodes arranged substantially within said end chambers, and press seals sealing the ends of said arc tube in a gas-tight manner, the improvement comprising:

said press seals lie in a common plane offset from said cylinder axis in a direction normal to said press seals;

the circumferential portion of said generally cylindrical body towards which said press seals are offset is smoothly curving and free of flats in cross sections normal to said cylinder axis and free of longitudinally extending zones of locally irregular curvature in which the curvature is irregular, in cross-sections normal to the longitudinally extending zones; and the portions of said end chambers extending between said press seals and said circumferential portion are smoothly curving and free of crevices (i) in cross-sections parallel to and (ii) cross-sections normal to the cylinder axis.

2. An arc tube according to claim 1, wherein said press seals lie in a common plane.

3. An arc tube according to claim 2, wherein said arc tube is symmetrical about a central plane through said cylinder axis and normal to said press seals.

4. An arc tube according to claim 3, wherein said cylindrical body is a right circular cylinder.

5. An arc tube according to claim 4, further comprising a starting electrode adjacent one of said discharge electrodes and connected to an additional lead-through, said lead-throughs of said discharge and starting electrodes being laterally offset within said press seal on opposite sides of said central plane, and said discharge electrode terminating at an electrode tip and being angled in the plane of said press seal such that said electrode tip is positioned on said central plane.

6. An arc tube according to claim 2, wherein said discharge electrodes are aligned with each other and extend parallel to said cylinder axis.

7. An arc tube according to claim 1, further comprising a starting electrode adjacent one of said discharge electrodes and connected to an additional lead-through, said lead-throughs of said discharge and starting electrodes being laterally offset within said press seal on opposite sides of said cylinder axis, and said discharge electrode terminating at an electrode tip and being angled in the plane of said press seal such that said electrode tip is laterally positioned on a central plane extending normal to said press seals and through said cylinder axis.

8. An arc tube according to claim 1, wherein said discharge electrodes are aligned with each other and extend parallel to said cylinder axis.

9. A high pressure discharge lamp according to claim 1, wherein said cylindrical body is a right circular cylinder.

10. A high pressure discharge lamp having an arc tube for operation in a generally horizontal position, said arc tube having a generally cylindrical body having a cylinder axis defined by the center of mass of the enclosed area of cross-sections of the generally cylindrical body, end chambers of continuously reducing cross-section, an arc discharge sustaining filling, a pair of opposing discharge electrodes arranged substantially in said end chambers, and press seals sealing each end of said arc tube in a gas-tight manner, wherein the improvement comprises:

said press seals are in planes offset from said cylinder axis in a direction normal to said press seals;

the circumferential portion of said generally cylindrical body towards which said press seals are offset is smoothly curving and free of flats in cross sections normal to said cylinder axis, and free of longitudinally extending zones of locally irregular curvature in which the curvature is irregular, in cross-sections normal to the longitudinally extending zones;

the portions of said end chambers extending between said press seals and said circumferential portion are smoothly curving and free of crevices (i) in cross-sections parallel to and (ii) cross-sections normal to the cylinder axis; and in its generally horizontal operating position, said press seals lie substantially horizontally and said circumferential body portion and said portions of said end chambers lie below said press seals.

11. A high pressure discharge lamp according to claim 10, wherein said press seals lie in a common plane.

12. A high pressure discharge lamp according to claim 11, wherein said arc tube is symmetrical about a central plane through said cylinder axis and normal to said press seals.

13. A high pressure discharge lamp according to claim 12, wherein said cylindrical body is a right circular cylinder.

14. A high pressure discharge lamp according to claim 13, wherein said discharge electrodes are aligned with each other and said central plane and extend in said common press seal plane.

15. A high pressure discharge lamp according to claim 13, wherein a said discharge electrode terminates at a tip thereof and is angled in the plane of said press seal such that said electrode tip is positioned on said central plane and said lead-through extends in said press seal laterally offset from said central plane.

16. A high pressure discharge lamp according to claim 15, further comprising a starting electrode adjacent said angled discharge electrode and connected to an additional lead-through, said lead-through of said starting electrode being laterally offset within said press seal on the opposite side of said central plane from said discharge electrode lead-through.

17. A high pressure discharge lamp according to claim 12, wherein said discharge electrodes are aligned with each other and said central plane and extend in said common press seal plane.

18. A high pressure discharge lamp according to claim 12, wherein a said discharge electrode terminates at a tip thereof and is angled in the plane of said press seal such that said electrode tip is positioned on said central plane and said lead-through extends in said press seal laterally offset from said central plane.

19. A high pressure discharge lamp according to claim 18, further comprising a starting electrode adjacent said angled discharge electrode and connected to an additional lead-through, said lead-through of said starting electrode being laterally offset within said press seal on the opposite side of said central plane from said discharge electrode lead-through.

20. A high pressure lamp according to claim 10, further comprising a starting electrode adjacent one of said discharge electrodes and connected to an additional lead-through, said lead-throughs of said discharge and starting electrodes being laterally offset within said press seal on opposite sides of said cylinder axis, and said discharge electrode terminating at an electrode tip and being angled in the plane of said press seal such that said electrode tip is laterally positioned on a central plane extending normal to said press seals and through said cylinder axis.

21. A high pressure discharge lamp according to claim 10, wherein said discharge electrodes are aligned with each other and extend parallel to said cylinder axis.

22. A high pressure discharge lamp according to claim 10, wherein said cylindrical body is a right circular cylinder.

23. A high pressure discharge lamp, comprising:

a) an outer envelope;

b) an arc tube arranged within said outer envelope for operation in a generally horizontal operating position, said arc tube having a tubular body with a tubular axis defined by the center of mass of the cross-sections of said tubular body, end chambers of continuously reducing cross-section, an arc discharge sustaining filling, and a pair of opposing discharge electrodes arranged substantially in said end chambers, said press seals lying in a plane offset from said tubular axis in a direction normal to said press seals and said tubular body being symmetric about another plane through said tubular axis and parallel to said press seals; and c) means for supporting said arc tube in said outer envelope and for connecting said discharge electrodes to a source of electric potential outside of said envelope.

24. A high pressure discharge lamp according to claim 23, wherein said tubular body is cylindrical and said press seals lie substantially horizontally in the generally horizontal operating position of said arc tube.

25. A high pressure discharge lamp according to claim 24, wherein said tubular body has a circular cross-section along its entire length between said end chambers.

26. A high pressure discharge lamp according to claim 23, wherein said tubular body has a circular cross-section along its entire length between said end chambers.

27. A high pressure discharge lamp, comprising:

a) an outer envelope;

b) an arc tube arranged within said outer envelope, said arc tube having a tubular body, end chambers of continuously reducing cross-section, an arc discharge sustaining filling, and a pair of opposing discharge electrodes arranged substantially in said end chambers, said tubular body having a circumferential wall portion extending between said end chambers which has a semi-circular cross section defining an axis of said wall portion, said press seals and said discharge electrodes lying in a common plane offset from said axis in a direction normal to said press seals and away from said wall portion; and c) means for supporting said arc tube in said outer envelope and for connecting said electrodes to a source of electric potential outside of said envelope.

* * * * *